US008864505B2

(12) United States Patent
Chuang

(10) Patent No.: US 8,864,505 B2
(45) Date of Patent: Oct. 21, 2014

(54) ANTI-ELECTRIC SHOCK POWER SOCKET

(75) Inventor: Johnson Chuang, Guangdong Province (CN)

(73) Assignee: Dongguan KO TEC Electrical Utensils Inc., Guangdong Province (CN)

( * ) Notice: Subject to any disclaimer, the term of this patent is extended or adjusted under 35 U.S.C. 154(b) by 91 days.

(21) Appl. No.: 13/559,629

(22) Filed: Jul. 27, 2012

(65) Prior Publication Data

US 2013/0295789 A1 Nov. 7, 2013

(30) Foreign Application Priority Data

May 4, 2012 (CN) ..... 2012 1 0135869

(51) Int. Cl.
*H01R 13/648* (2006.01)

(52) U.S. Cl.
USPC ..... 439/107; 439/652; 200/51.02

(58) Field of Classification Search
USPC ..... 439/650–652, 107, 214
See application file for complete search history.

(56) References Cited

U.S. PATENT DOCUMENTS

| | | | | |
|---|---|---|---|---|
| 5,526,225 | A * | 6/1996 | Wang | 361/643 |
| 6,054,657 | A * | 4/2000 | Liao | 200/51.02 |
| 6,454,609 | B1 * | 9/2002 | Huang | 439/652 |
| 6,767,245 | B2 * | 7/2004 | King | 439/535 |
| 7,195,500 | B2 * | 3/2007 | Huang et al. | 439/107 |
| 8,044,299 | B2 * | 10/2011 | Weeks | 174/53 |

* cited by examiner

*Primary Examiner* — Hien Vu

(57) ABSTRACT

An anti-electric shock power socket comprising a main housing body; a negative electrode holder, installed in the main housing body and connected to a negative electrode of a power supply for holding a negative prong of an inserted plug; a positive electrode holder, installed in the main housing body for holding a positive prong of an inserted plug, wherein the positive electrode holder is provided with an overlapping spring plate which can be pushed outward by the inserted positive prong; a positive conducting plate installed in the main housing body and connected to the positive electrode of the power supply. Only when the plug is correctly inserted, the overlapping spring in the positive electrode holder is driven so it overlaps with the positive conducting plate to be closed-circuited with the positive electrode so as to supply power to an electric appliance.

8 Claims, 13 Drawing Sheets

ANTI-ELECTRIC SHOCK POWER SOCKET

BACKGROUND OF THE INVENTION

The invention relates to the technical field of power sockets, in particular to an anti-electric shock power socket.

The power sockets available on the market have multiple pressure units; each pressure unit usually includes a negative electrode holder and a positive electrode holder; the negative and positive electrode holders are connected to the power line by welding and wiring. In the viewpoint of manufacturing, the power socket is usually full of wires connected to each pressure unit, which not only makes the manufacturing inconvenient, it also increases cost. Besides, the power socket is internally wound with several segments of wires connected to each pressure unit, so overheating and short-circuiting phenomena are easily generated due to the inductive effect to cause danger. Thus, the existing power socket is necessary to improve because of the mentioned defects.

BRIEF SUMMARY OF THE INVENTION

The invention aims to overcome the shortcomings in the prior art to provide a power socket with a normally-on positive electrode.

To fulfill the mentioned aim, the present invention adopts the following technical scheme: the invention adopts the following technical scheme:

The invention has the advantages that: the negative electrode holder is directly connected to the negative electrode of the power supply and is usually closed-circuit; the negative electrode holder is not powered on, so even if a child inserts a metal plate into the negative electrode holder, no short-circuit accident will be caused; according to demands, the negative electrode holder can be equipped with the negative overlapping spring plate and the negative conducting plate like the positive electrode, or the positive electrode holder and the positive electrode of the power supply are short-circuited; only the right plug is inserted, the overlapping spring plate in the positive electrode holder is driven so it overlaps with the positive electrode conducting plate and forms a closed circuit with the positive electrode to supply power to the electric appliance; the invention can prevent children from plugging into the metal plate and receiving an electric shock and has a simplified structure, because unlike the positive electrode the negative electrode holder does not need the overlapping spring plate and the negative electrode conducting plate, and therefore, manufacturing costs is reduced.

DETAILED DESCRIPTION OF THE INVENTION

Figure 1:
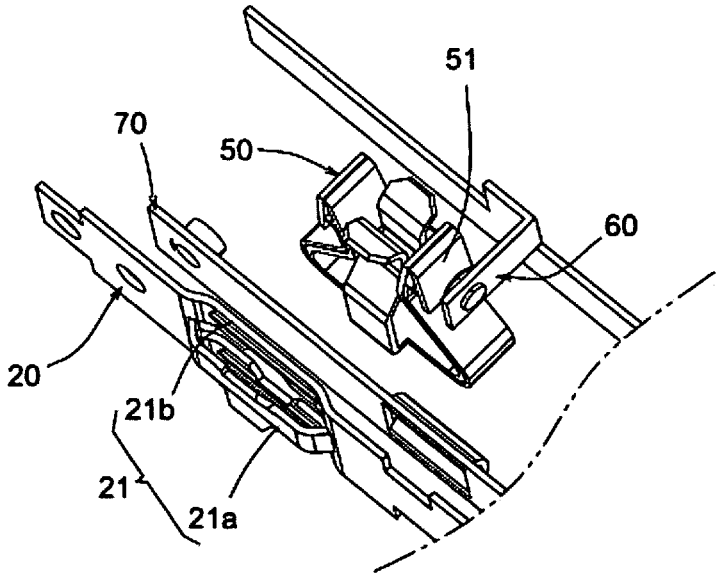
FIG. 1 is a local three-dimensional view of the embodiment 1 of the invention.

The invention is further described in detail with the reference of the attached drawings.

As shown in FIGS. 1-17, the invention discloses an anti-electric shock power socket, which comprises a main housing body 10; a negative electrode holder 20, installed in the main housing body 10 and connected to a negative electrode 31 of a power supply 30 for holding a negative prong 41 of an inserted plug 40;

a positive electrode holder 50 installed in the main housing body 10 for holding a positive prong 42 of the inserted plug 40, wherein the positive electrode holder 50 is provided with an overlapping spring plate 51 which can be pushed outward by the inserted positive prong 42;

a positive conducting plate 60, installed in the main housing body 10 and connected to a positive electrode 32 of the power supply 30, wherein after the overlapping spring plate 51 of the positive electrode holder 50 is pushed outward by the positive prong 42 by the inserted plug, the overlapping spring plate 51 is overlapped with the positive conducting plate 60; when the plug of an appliance is not inserted into the power socket, the positive electrode holder 50 has no charges, which effectively preventing the children plugging conductors into the socket from electric shock; the invention has a simple structure low cost and is safe.

Figure 18:
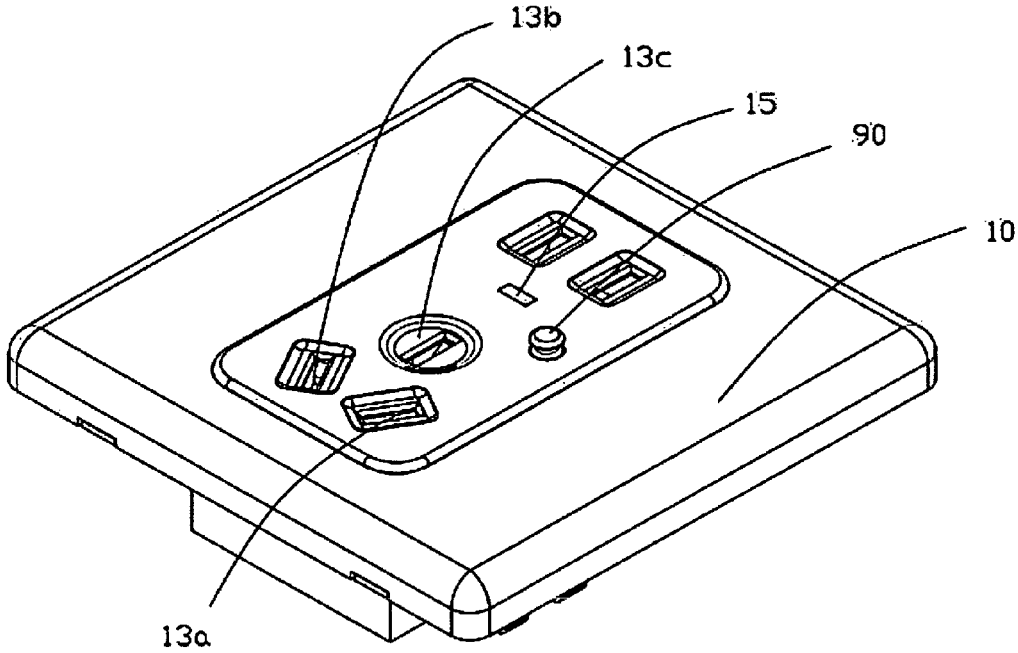
FIG. 18 is a three-dimensional exploded view of the embodiment 4 established according to the standards used in China mainland.
Figure 19:
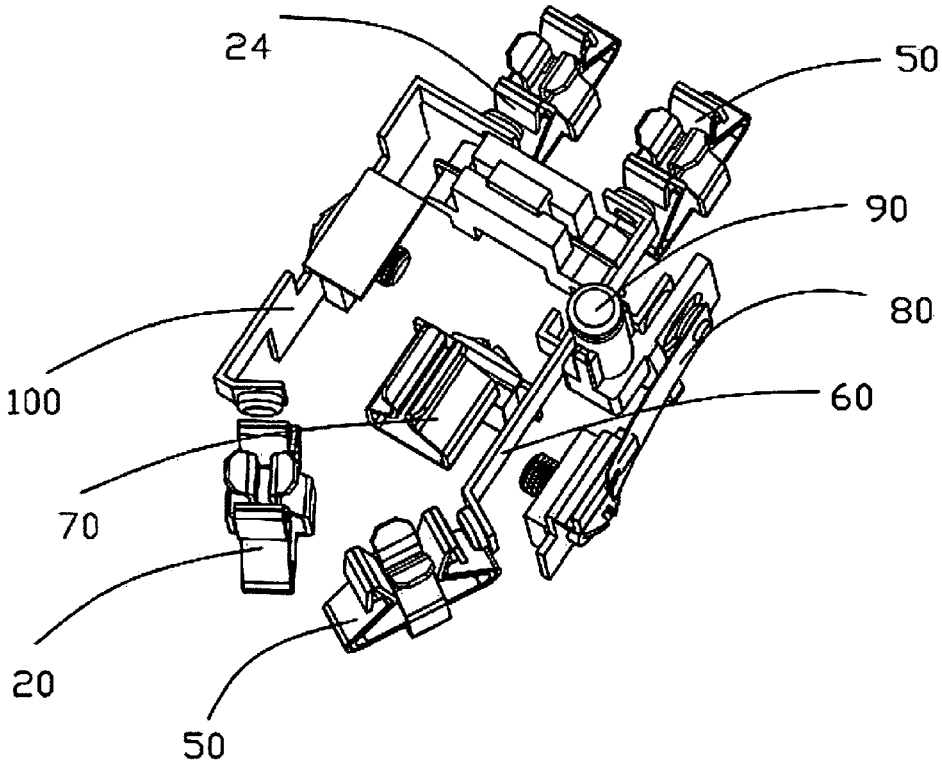
FIG. 19 is a three-dimensional view of the principle of switching on the inner circuit as shown in FIG. 18.

As shown in FIG. 18 and FIG. 19, the negative electrode holder 20 is provided with a negative overlapping spring plate 24 which can be pushed outward by the negative prong 41 of the inserted plug; the power socket also comprises a negative conducting plate 100 installed in the main housing body 10 and connected to the negative electrode 31 of a power supply; and after the negative overlapping spring plate 24 of the negative electrode holder 20 is pushed outward by the negative prong 41 of the inserted plug, the negative overlapping spring plate 24 is overlapped on the negative conducting plate 100. Thus, children plugging conductors into the socket can be prevented from receiving an electric shock under the condition that the positive and negative electrodes of the external power supply are disconnected.

The power socket of the invention is also provided with a grounding member 70 installed in the main housing body 10 and connected to a ground wire 33 of the power supply 30 for holding the ground prong 43 of the inserted plug 40.

Figure 5:
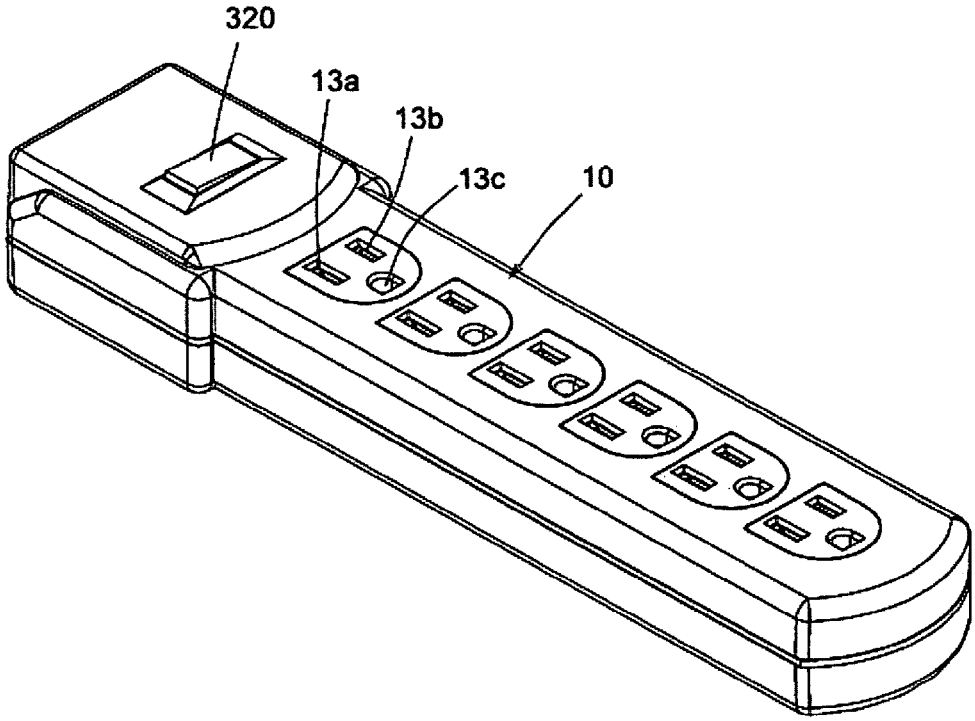
FIG. 5 is a three-dimensional external view of a power extension line of the invention.
Figure 6:
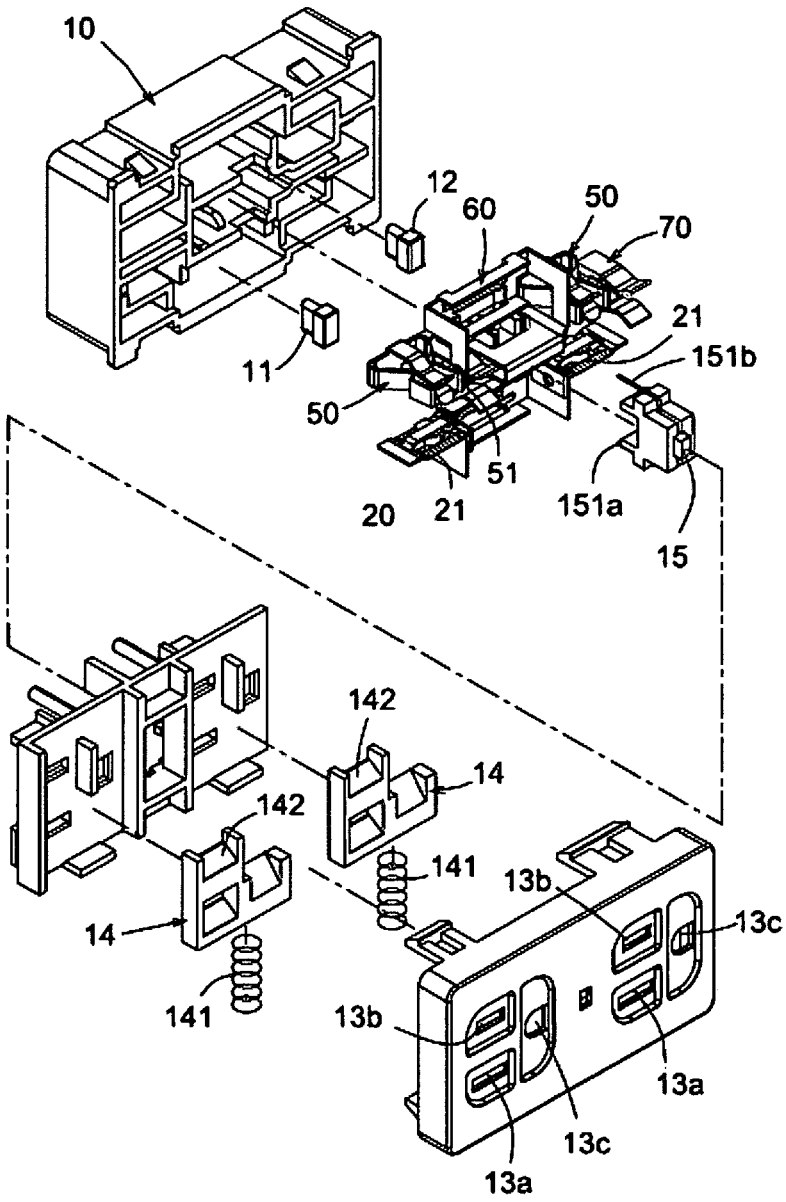
FIG. 6 is a three-dimensional exploded view of the embodiment 2 of the invention.
Figure 7:
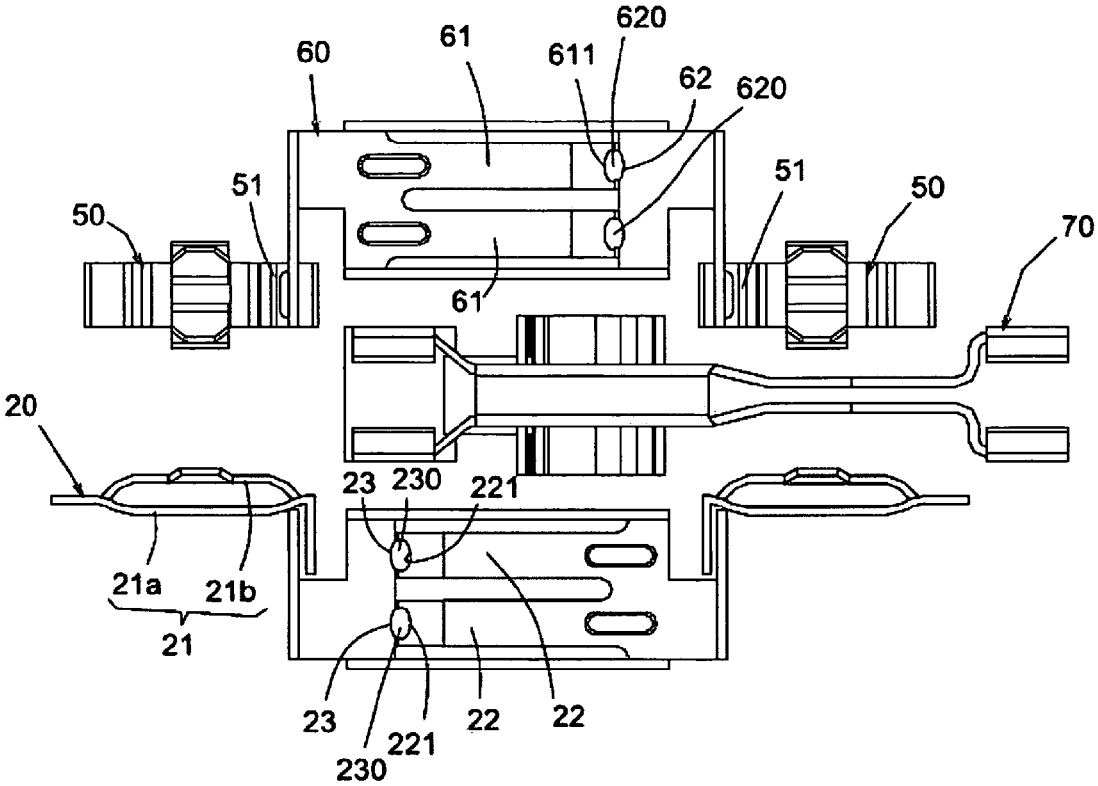
FIG. 7 is a schematic view of a planer structure of part of the components of the embodiment in FIG. 6.
Figure 8:
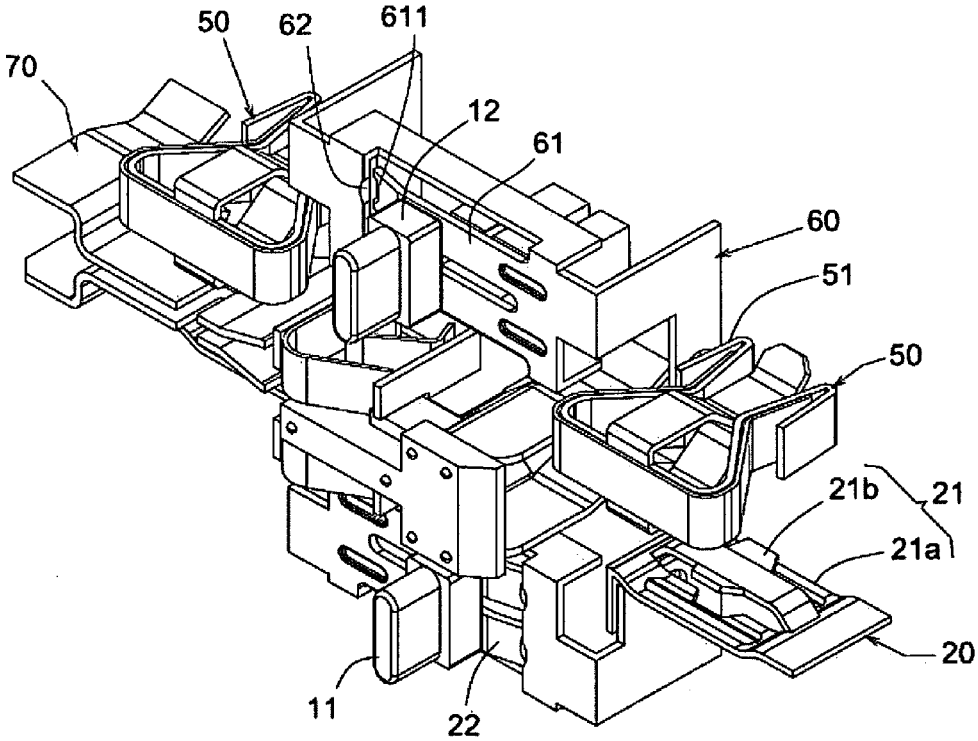
FIG. 8 is a three-dimensional view of the embodiment as shown in FIG. 6 after assembly.
Figure 9:
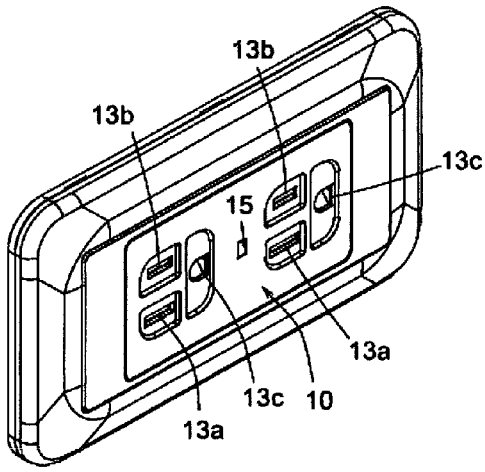
FIG. 9 is a three-dimensional view of the relationship among part of the components of the embodiment as shown in FIG. 6.
Figure 10:
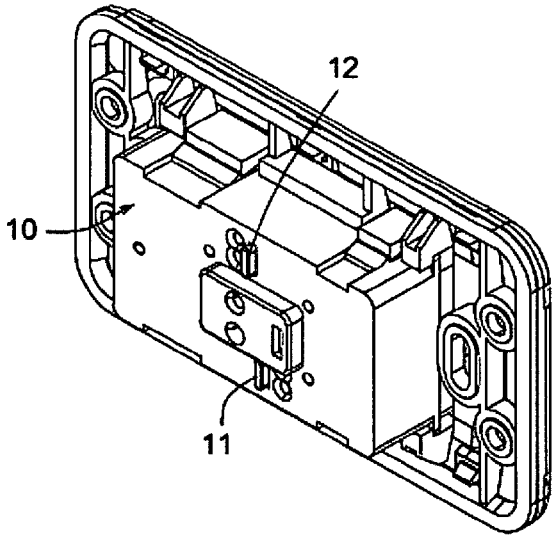
FIG. 10 is a three-dimensional view of the embodiment as shown in FIG. 6 after assembly at another view angle.
Figure 11:
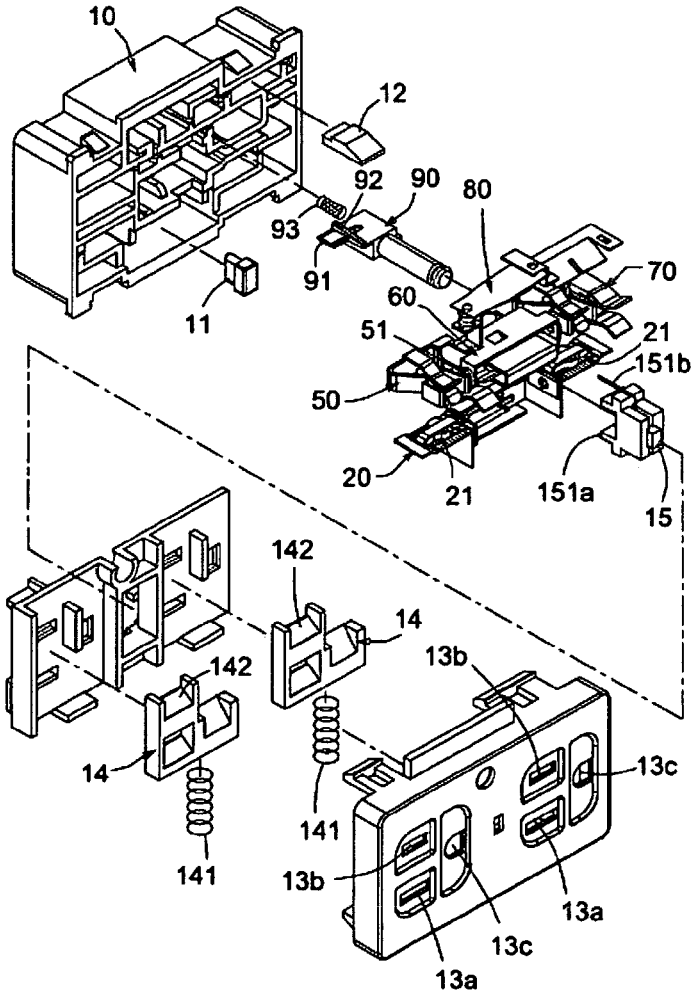
FIG. 11 is a three-dimensional exploded view of the embodiment 3 of the invention.
Figure 12:
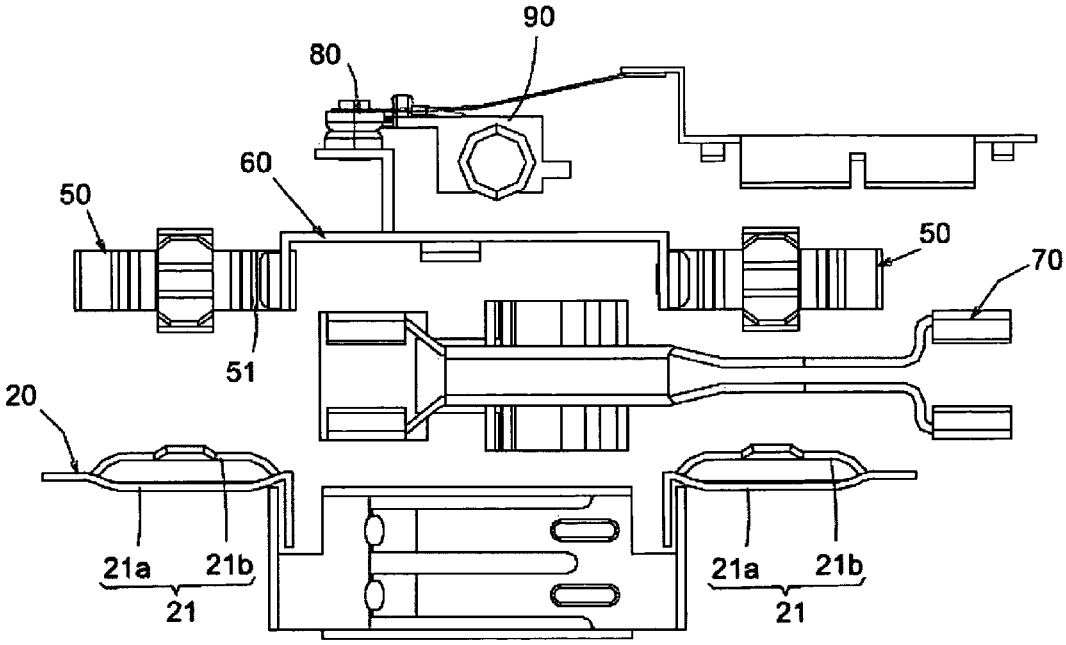
FIG. 12 is a schematic view of a planer structure of part of the components of the embodiment as shown in FIG. 11.
Figure 13:
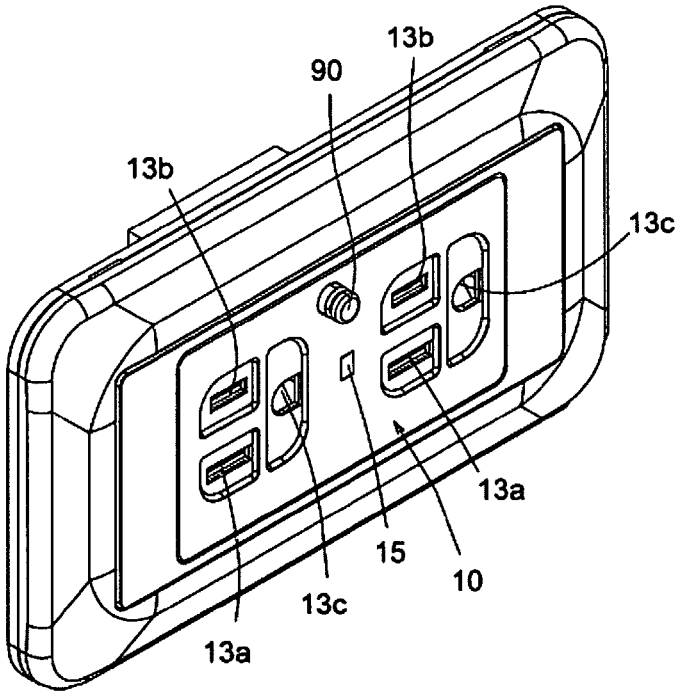
FIG. 13 is a three-dimensional view of the embodiment as shown in FIG. 11 after assembly.
Figure 14:
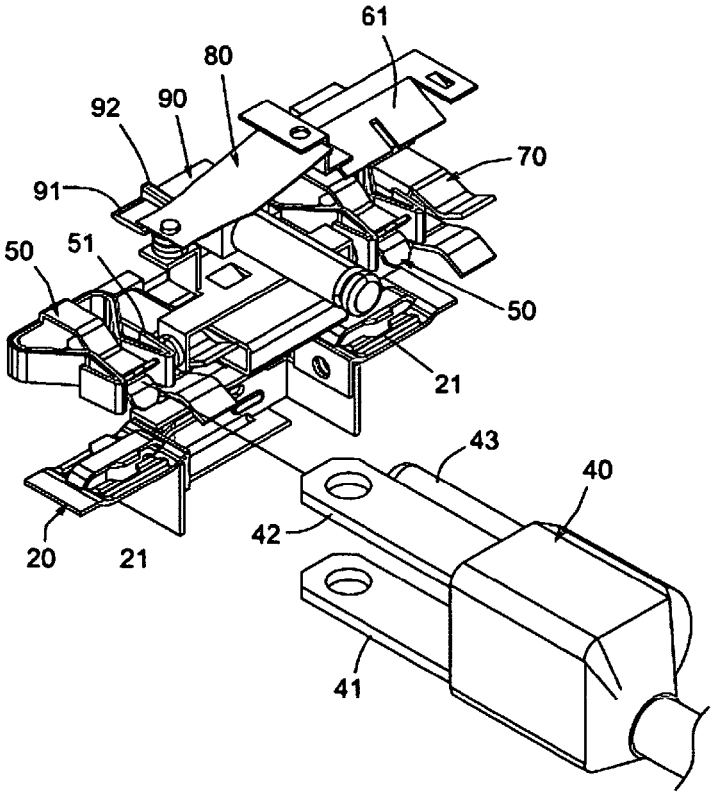
FIG. 14 is a three-dimensional view of the relationship among part of the components of the embodiment as shown in FIG. 11.
Figure 15:
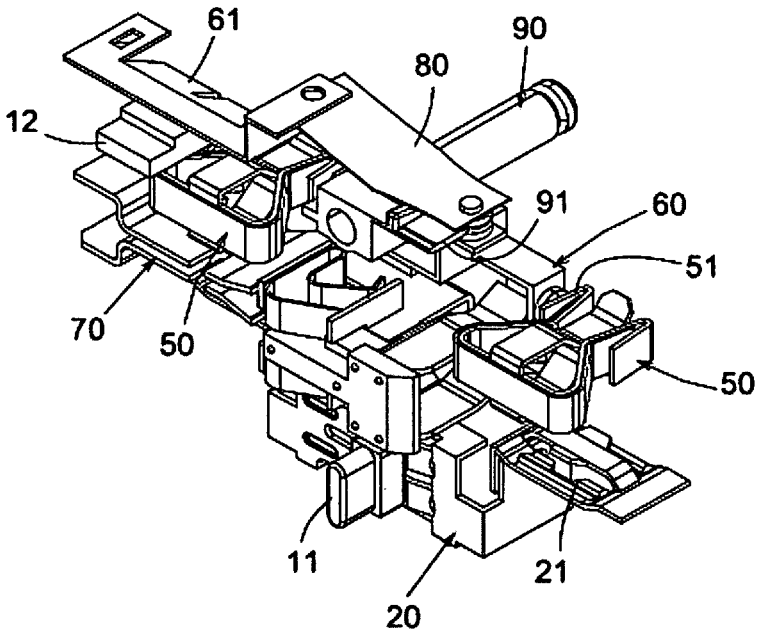
FIG. 15 is a three-dimensional view of the embodiment as shown in FIG. 14 at another view angle.

The main housing body 10 of the power socket in the invention may refer to the main housing body 10 of the power extension line as shown in FIG. 5 or the main housing body 10 of the power socket installed on a wall as shown in FIGS. 6, 7, 11 and 12.

Figure 2:
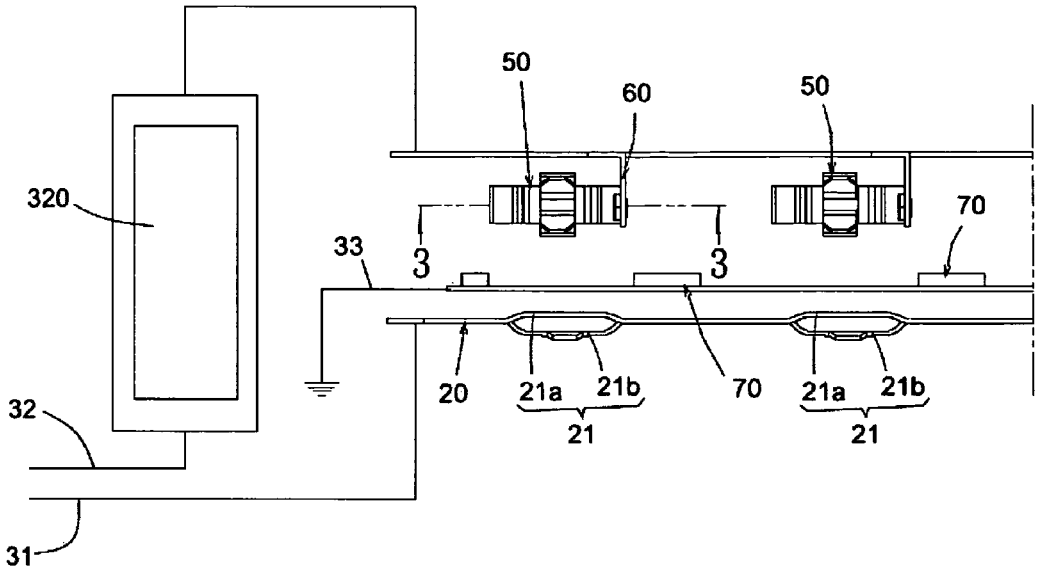
FIG. 2 is a top view of the embodiment 1 of the invention.
Figure 3:
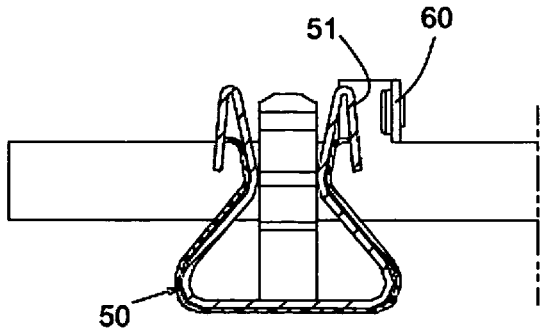
FIG. 3 is a sectional structure view of the FIG. 2 in the 3-3 direction.
Figure 4:
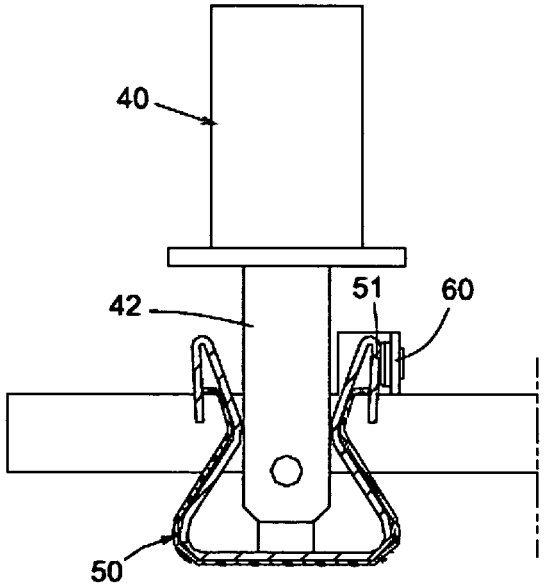
FIG. 4 is a state view of the FIG. 3 after being inserted with a plug.

As shown in FIG. 2, the positive electrode 32 of the power supply 30 can be connected to a selector switch 320 in series to switch the open-circuit state of the positive electrode 32.

As shown in FIGS. 1 and 2, the negative electrode holder 20 of the power socket in the invention is integrally molded by punching a metal plate. The negative electrode holder 20 has a holder portion 21 consisting of two plates 21*a* and 21*b* located on two sides; the plates 21*a* and 21*b* on two sides define a holding cavity for elastic holding the negative prong 41 of the inserted plug. The negative electrode holder 20 in the invention can be formed with odd holder portions 21 (for use of the single-provide pressure plug) or several holder portions 21 (for use of the multi-provide pressure wall plug or extension line).

As shown in FIGS. 6-10, the negative electrode holder 20 of the power socket in the invention is also provided with a conductive holding spring plate 22; the free end 221 of the conductive holding spring plate 22 and the fixed side 23 on the negative electrode holder 20 form a wire holding cavity 230 to tightly hold and clamp the inserted the wire in a one-way mode and prevent the wire from being pulled out. The main housing body 10 is provided with an unlocking button 11 inside in a sliding way; the unlocking button directly faces the wire holding spring plate 22; after being pressed, the unlocking button 11 can provide pressure and remove the wire holding spring plate 22 to push the free end of the conductive holding spring plate 22 away from the fixed side 23 on the negative electrode holder 20 so as to unlock the held wire.

The positive electrode holder 60 of the power socket in the invention is also provided with a holding spring plate 61; the free end 611 of the holding spring plate 61 and the fixed side 62 on the positive electrode holder 60 form a wire holding cavity 620 to tightly hold and clamp the inserted the wire in a one-way mode and prevent the wire from being pulled out. The invention provides a power socket with a normally-on positive electrode, wherein the main housing body 10 is provided with a sliding push button 12; the push button 12 directly faces the holding spring plate 61; after being pressed, the push button 12 can provide pressure and remove the holding spring plate 61 to push the free end 611 of the holding spring plate 61 away from the fixed side 62 on the positive conducting plate 60 so as to unlock the held wire.

Figure 16:
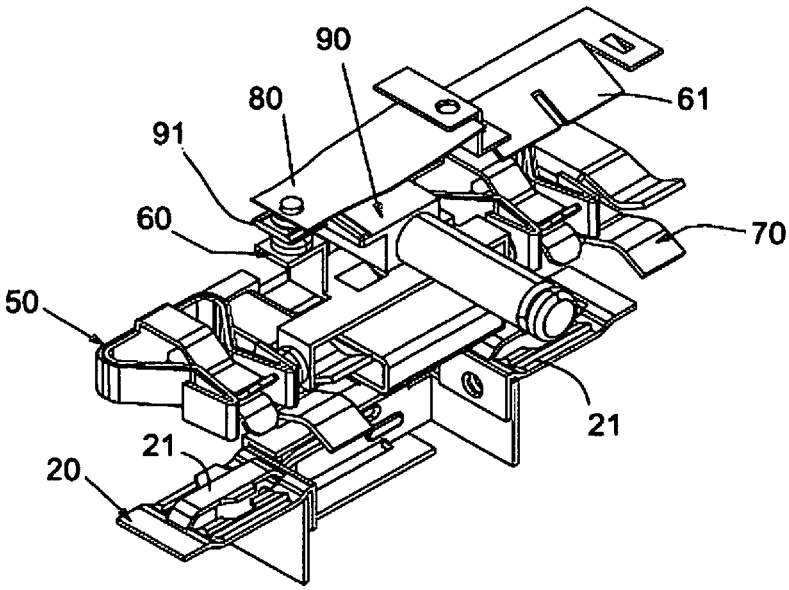
FIG. 16 is a schematic view of the power failure state of the embodiment as shown in FIG. 11.
Figure 17:
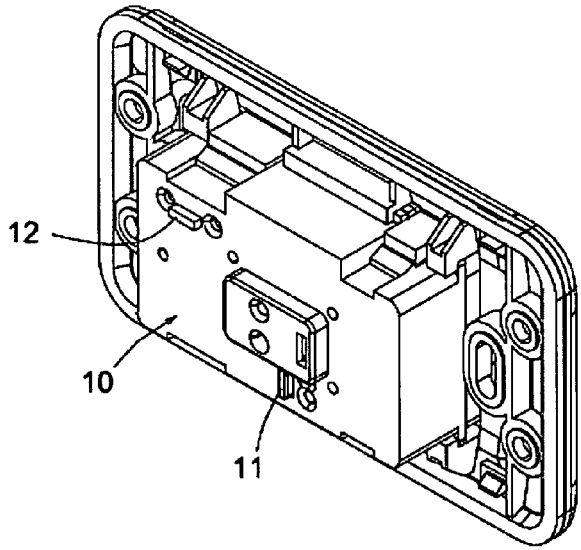
FIG. 17 is a three-dimensional view of the embodiment as shown in FIG. 11 after assembly at another view angle.

As shown in FIGS. 11-17, in the power socket disclosed in this invention, a reed switch 80 is arranged between the positive conducting plate 60 and the positive electrode 32; usually, the reed switch 80 is overlapped with the positive conducting plate 60, forming a closed circuit; in case of overloading, the reed switch 80 automatically springs outward to form an open circuit together with the positive conducting plate 60. Thus, the power socket is safe in use. A sliding interceptor rod 90 is installed at the overlapping position of the reed switch 80 and the positive conducting plate 60; the interceptor rod 90 has a partition portion 91; one side, facing the reed switch 80, of the interceptor rod 90 is provided with a protruding rib 92; a spring 93 is supported between the interceptor rod 90 and the main housing body 10; usually the spring 93 provide pressures and pushes the interceptor rod 90 and pushes the partition portion 91 pressed against the bottom of the position wherein the reed switch 80 and the positive conducting plate 60 contact each other; if the reed switch 80 springs outside due to over-current, the interceptor rod 90 is actuated by the spring 93 to move the partition portion 91 to a position between the reed switch 80 and the positive conducting plate 60, and then the protruding rib 92 is pressed against the side wall of the reed switch 80 to prevent the reed switch 80 from overlapping with the positive conducting plate 60 and form a stable power failure state, as shown in FIG. 16; The interceptor rod 90 also may be pulled out according to the user's demands, so the partition 91 is moved to a position between the reed switch 80 and a positive conducting plate 60, and the protruding rib 92 is leaned against the side wall of the reed switch to prevent the reed switch 80 from overlapping with the positive conducting plate 60 and form a stable power failure state. The reed switch 80 is a bimetallic plate; the outside of the bimetallic plate is provided with a metal with a small thermal expansion rate, and the inner side is provided with a metal with a large thermal expansion rate. When the power socket is overheated, the power supply is cut by the expansion action of the bimetallic plate of the reed switch 80 to perform overload protection.

As shown in FIGS. 6-11, in the power socket provided by the invention, the main housing body 10 is provided with at least one group of provide pressures 13,*a* 13*b* and 13*c*; a shield 14 is arranged below each group of provide pressures 13,*a* 13*b* and 13*c*; usually, the shield 14 is pushed by a spring 141 to shield the provide pressures 13,*a* 13*b* and 13*c* so as to prevent entrance of the dust or foreign matters; the shield 14 is provided with a guide bevel portion 142; when the plug 40 is inserted, the positive prong, negative prong and ground prong of the plug 40 can provide pressure and remove the shield 14 along with the guide bevel portion 142 to insert into the main housing body so as to be deep into the corresponding positive electrode holder 40, positive electrode holder and ground member.

In the power socket provided by the invention, the outer side of the main housing body 10 is also provided with a power indicator 15 which has a light-emitting component 151; a first pin 151*a* of the light-emitting component 15 is overlapped on the negative electrode holder 20, while the second pint 151*b* of the light-emitting component 15 is overlapped on the positive conducting plate 60; usually, the light-emitting component 15 turns on, and in case of power failure, it turns off.

The invention has the advantages that: the negative electrode holder 20 is directly connected to the negative electrode 31 of the power supply 30 and is usually closed-circuit; the negative electrode holder 20 is not powered on, so even if a child inserts a metal plate into the negative electrode holder 20, no short-circuit accident will be caused; according to demands, the negative electrode holder 20 can be equipped with the negative overlapping spring plate 24 and the negative conducting plate 100 like the positive electrode, or the positive electrode holder 50 and the positive electrode 32 of the power supply 30 are short-circuited; only the right plug is inserted, the overlapping spring plate 51 in the positive electrode holder 50 is driven so it overlaps with the positive electrode conducting plate 60 and forms a closed circuit with the positive electrode 32 to supply power to the electric appliance; the invention can prevent children that plug metal objects into the socket from receiving an electric shock and has a simplified structure because unlike the positive electrode the negative electrode holder 20 does not need the overlapping spring plate and the negative electrode conducting plate, and therefore, manufacturing costs is reduced.

What is claimed is:

1. An anti-electric shock power socket, comprising a main housing body;

a negative electrode holder, installed in the main housing body and connected to a negative electrode of a power supply for holding a negative prong of an inserted plug; a positive electrode holder, installed in the main housing body for holding a positive prong of the inserted plug; characterized in that the positive electrode holder is provided with an overlapping spring plate which is capable to be pushed outward by the positive prong inserted therein; the anti-electric shock power socket also comprises: a positive conducting plate installed in the main housing body, wherein the positive conducting plate is connected to a selector switch and the selector switch is connected to a positive electrode of the power supply; and after the overlapping spring plate of the positive electrode holder is pushed outward by the positive prong of the inserted plug, the overlapping spring plate is overlapped on the positive conducting plate; a reed switch is installed between the positive conducting plate and the positive electrode holder; an interceptor rod is installed between the reed switch and the positive conducting plate is slidably installed between the reed switch and the positive conducting plate; the interceptor rod is provided with a partition portion; one side, facing the reed switch, of the interceptor rod is provided with a protruding rib; a spring is supported between the interceptor rod and the main housing body; usually the spring provide presses and pushes the interceptor rod and makes the partition portion connect with a bottom of a position where the reed switch and the positive conducting plate contact each other; when the reed switch springs outward due to over-current, the interceptor rod is actuated by the spring to move the partition portion to a position between the reed switch and the positive conducting plate, and then the protruding rib is pressed against the side wall of the reed switch.

2. The anti-electric power socket according to claim 1, characterized in that the reed switch is a bimetallic strip; an outer side of the bimetallic strip is provided with a metal with a small thermal expansion rate, while an inner side is provided with a metal with a large thermal expansion rate.

3. The anti-electric power socket according to claim 1, characterized in that the main housing body is a main housing body of a power extension line or a main housing body of a wall socket installed on a wall surface.

4. The anti-electric power socket according to claim 1, characterized in that the negative electrode holder is integrally molded by punching a metal plate, and has a holder portion which is formed by plates on two sides, so the plates on both sides define and form a holding cavity for elastically surrounding and holding the inserted negative prong.

5. The anti-electric power socket according to claim 4, characterized in that the negative electrode holder is formed with multiple holder portions.

6. The anti-electric power socket according to claim 1, characterized in that the negative electrode holder is provided with a conductive holding spring plate; a free end of the conductive holding spring plate and a fixed side of the negative electrode holder form a wire holding cavity; the main housing body is also provided with a sliding unlocking button inside; the unlocking button directly faces a wire holding spring plate; after being pressed, the unlocking button can provide pressure and remove the wire holding spring plate to push the free end of the conductive holding spring plate away from the fixed side of the negative electrode holder.

7. The anti-electric power socket according to claim 1, characterized in that the positive conducting plate is provided with a holding spring plate; the free end of the holding plastic spring and the fixed side on the positive conducting plate form a wire holding cavity; the main housing body is also provided with a push button which directly faces the holding spring plate; after being pressed, the push button can provide pressure and remove the holding spring plate to push the free end of the holding spring plate away from the fixed side on the positive conducting plate so as to unlock the held wire.

8. The anti-electric power socket according to claim 1, characterized in that the negative electrode holder is provided with a negative overlapping spring plate which can be pushed outward by the negative prong of the inserted plug; the power socket also comprises a negative conducting plate installed in the main housing body and connected to the negative electrode of a power supply; and after the negative overlapping spring plate of the negative electrode holder is pushed outward by the negative prong of the inserted plug, the negative overlapping spring plate is overlapped on the negative conducting plate.

* * * * *